US006595903B2

(12) United States Patent
Nerio et al.

(10) Patent No.: US 6,595,903 B2
(45) Date of Patent: Jul. 22, 2003

(54) DEVICE FOR SELECTIVELY VARYING, IN AN EXERCISE APPARATUS, FORCES AND MOVEMENTS BETWEEN A MOVEMENT ORGAN AND RESISTIVE MEANS

(75) Inventors: Alessandri Nerio, Longiano (IT); Zaccherini Leo, Riolo Terme (IT)

(73) Assignee: Technogym S.r.l., Gambettola (IT)

( * ) Notice: Subject to any disclaimer, the term of this patent is extended or adjusted under 35 U.S.C. 154(b) by 53 days.

(21) Appl. No.: 09/838,336

(22) Filed: Apr. 20, 2001

(65) Prior Publication Data

US 2001/0039233 A1 Nov. 8, 2001

(30) Foreign Application Priority Data

Apr. 21, 2000 (IT) ..... BO2000A0234

(51) Int. Cl.[7] ..... A63B 21/062

(52) U.S. Cl. ..... 482/100; 482/99; 482/101; 482/93

(58) Field of Search ..... 482/99–101, 138, 482/139, 93–98

(56) References Cited

U.S. PATENT DOCUMENTS 5,044,631 A * 9/1991 Jones ..... 272/134
5,044,632 A * 9/1991 Jones
5,054,773 A * 10/1991 Parviainen ..... 272/118
5,230,680 A * 7/1993 Wu ..... 482/97
5,263,915 A * 11/1993 Habing ..... 482/99
5,681,247 A * 10/1997 Webber ..... 482/100
6,270,447 B1 * 8/2001 La Placa ..... 482/100
6,302,833 B1 * 10/2001 Ellis et al. ..... 482/100
RE37,648 E * 4/2002 Fulks ..... 482/100

* cited by examiner

*Primary Examiner*—Nicholas D. Lucchesi
*Assistant Examiner*—L Amerson
(74) *Attorney, Agent, or Firm*—Arent Fox Kintner Plotkin & Kahn, PLLC

(57) ABSTRACT

A device for varying, in an exercise apparatus, forces and movements between a movement organ and a resistive component. The device includes a pulley; a movable structure bearing a pivot pin for rotation of the pulley to which is applied a traction force. A cable element is wound on the pulley and forms a pair of parallel branches, whereof one branch is connected to the resistive component and the other branch is connected to a bar movable within a guide. The device also includes selective fasteners which, in a first operative condition, anchor the bar to the guide opposing twice the force of the resistive component to the pin; and which, in the second operative condition, allow the bar to translate until the bar abuts the movable structure, opposing a reaction force equal to the reaction force of the resistive component to the pin.

7 Claims, 5 Drawing Sheets

DEVICE FOR SELECTIVELY VARYING, IN AN EXERCISE APPARATUS, FORCES AND MOVEMENTS BETWEEN A MOVEMENT ORGAN AND RESISTIVE MEANS

BACKGROUND OF THE INVENTION

The present invention relates to machines and equipment for exercising the muscles of the human body and, more in particular, it concerns a device for selectively varying, in a mechanical transmission, connecting a movement organ receiving a muscle action of a person performing the exercise and resistive means that oppose said muscle action, the forces and the movements exchanged between the movement organ and the resistive means.

The prior art concerning exercise machines and equipment provides for the use, as resistive means that oppose the muscle actions of the person who performs the exercise, of the weights connected to the movement organ by means of a cable, appropriately routed along a path determined by a series of pulleys variously located on the structure of the machine.

The weights are constituted by stacks of vertically superposed elements, which are selected in variable number according to the need of the person who performs the exercise. In such machines, loads may vary in intensity, by discrete quantities, according to multiples of the unit weight of each component of the stack and with the selection, on each occasion, of a greater or smaller number of components of the stack.

SUMMARY OF THE INVENTION

The aim of the present invention is to allow to vary the resistive load opposing the movement organ, without requiring a variation of the conformation of the set stack of weights, or of the number of components of the stack already selected.

In accordance with the invention, this aim is achieved by a device for selectively varying, in a mechanical transmission of an exercise apparatus connecting a movement organ receiving a muscle action of a person performing the exercise and resistive means that oppose said muscle action, the forces and the movements exchanged between said movement organ and said resistive means, characterized in that it comprises at least a pulley; a movable structure bearing a pivot pin for the rotation of the pulley, to which structure is applied a traction force correlated to the muscle effort which the person performing the exercise applies to said movement organ, said traction force being coplanar with, and directed transversely to, the axis of the rotary pin of the pulley; a cable element wound around an arc of the pulley in such a way as to form a pair of parallel branches, a first branch whereof has an end connected to the resistive means, the second branch instead having an end connected to a bar movable within a vertical guide; said device further comprising means for selectively fastening the movable bar and the fixed guide; said fastening means anchoring, in a first operative condition, the movable bar to the fixed guide, thereby opposing, to the traction force applied to the pivot pin of the pulley, a reaction force that is twice the reaction force of the resistive means; said fastening means leaving instead, in a second operative condition, the bar free to translate relative to the guide until it reaches a condition of abutment against the movable support structure, in which the traction force applied to the pivot pin is opposed by a reaction force equal to the reaction force of the resistive means.

BRIEF DESCRIPTION OF THE DRAWINGS

The technical features of the invention, according to the aforesaid aims, can be clearly noted from the content of the claims set out below and its advantages shall become more readily apparent in the detailed description that follows, made with reference to the accompanying drawings, which represent an embodiment provided purely by way of non limiting example, in which:

DESCRIPTION OF THE PREFERRED EMBODIMENTS

Figure 1:
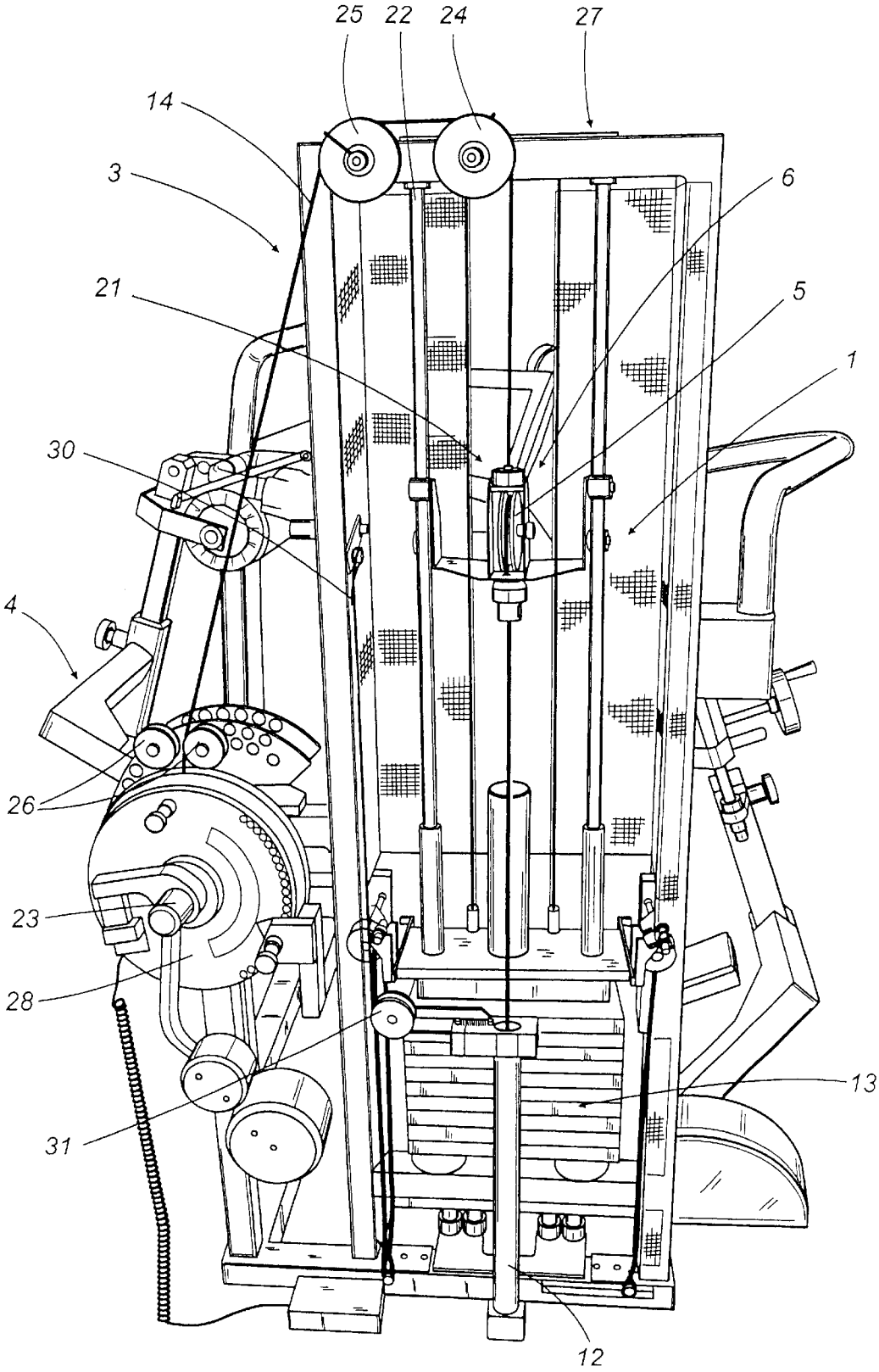
FIG. 1 is an overall perspective view of a generic exercise machine using a device according to the invention.

With reference to the figures of the accompanying drawings, the reference number 3 globally indicates a machine for exercise the muscular system of a person who, during the execution of the exercise, applies an action to a movement organ 4 setting in rotation a shaft 23 in opposition to the reaction developed by related resistive means which, by way of non limiting indication, are represented by a vertical, modular stack 13 of superposed metal plates.

The shaft 23 and the resistive means are mutually connected by a mechanical transmission of the cable type, represented by a cable element 14 situated between freely rotating pulleys 24, 25, 26 appropriately located on a structure 27 of the machine 3. The cable element 14 has an end connected to the stack 13 of weights and the other end connected to a disk 28 integral with the revolving shaft 23, with the interposition between the disk 28 and the stack 13 of a device 1 for selectively varying the forces and the movements exchanged between the movement organ 4 and the resistive means.

More specifically, a pair of idle pulleys 26, fastened to the structure 27 of the machine 3 and positioned at the periphery of the disk 28, bilaterally to the cable element 14, guides the winding of the cable element 14 itself along the periphery of the disk 28, whilst, as a consequence of the rotations, in the two directions, imparted to the disk 28 by the application: on one side, of the muscle effort of the person executing the exercise; and on the other side, of the reaction force exerted by the resistive means; the stack 13 of weights is lifted and lowered along fixed vertical guides 22, of the structure 27 of the machine 3.

The aforesaid device 1 for varying forces and movements is devised to selectively apply a multiplication or reduction of the effort of the stack 13 to the cable element 14, which lifts the stack 13 and, vice versa, holds the stack in descent during the operation of the machine 3.

Said device 1, in particular, comprises a pulley 5; and a movable structure 6 that includes a carriage 21 able to translate sliding along the vertical guides 22 of the fixed structure 27 of the machine 3 and that also sustains a pivot pin 7 for the rotation of the pulley 5.

The cable element 14 is anchored to the movable structure 6 whereto it applies a traction force correlated to the effort that the user applies to the movement organ 4: force, whose direction is transverse and coplanar with the axis of the pivot pin 7 of rotation of the pulley 5.

Another cable element 8 is wound around a superior arc of the pulley 5 in such a way as to form a pair of parallel branches 9, 10, which project below the movable structure 6.

A first branch 9 of said pair of branches 9, 10 has an end connected to the stack 13 of weights; the second branch 10 instead has an end connected to a bar 11 movable within a fixed vertical guide 12.

Selective fastening means are provided between the movable bar 11 and the fixed guide 12. These selective fastening means are embodied in particular by two parallel pins 15, positioned bilaterally to the branch 9 of cable element 14 that connects the bar 11 which slides within the fixed guide 12. The pins 15 are each housed in a seat 16, of the fixed guide 12, oriented transversely to the direction of sliding of the movable bar 11.

Figure 2:
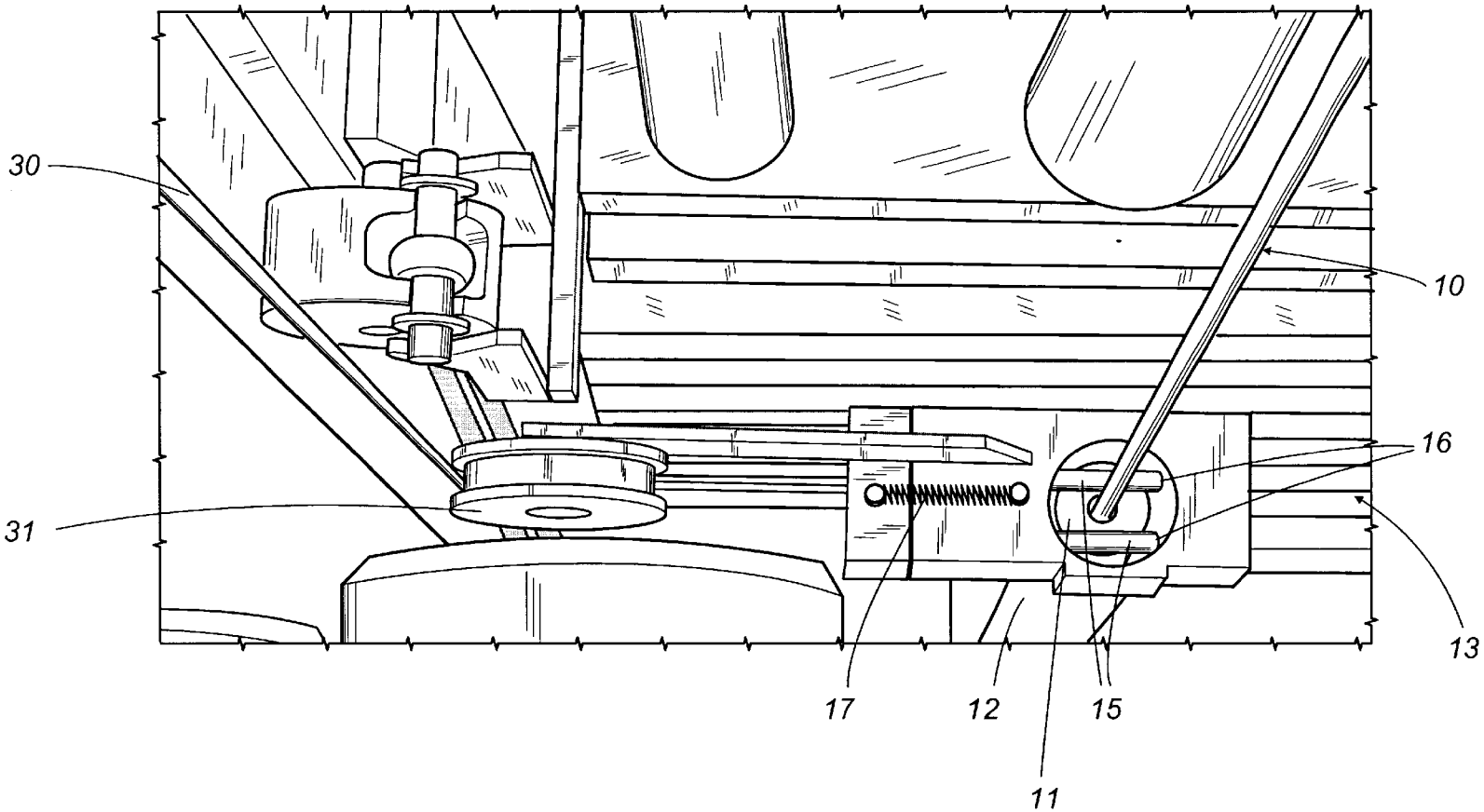
FIGS. 2, 3 and 4 are perspective views highlighting different significant operative conditions of the device.

The pins 15 are able to translate between extreme end stop positions in such a way that in a first end stop position (shown in FIG. 2) they intercept the free sliding of the bar 11 that is locked within the guide 12 and made integral therewith; in the second end stop condition (shown in FIGS. 3 and 4) the pins 15 are translated within the related seats 16 and instead allow the free movement of the bar 11 along the guide 12.

Figure 4:
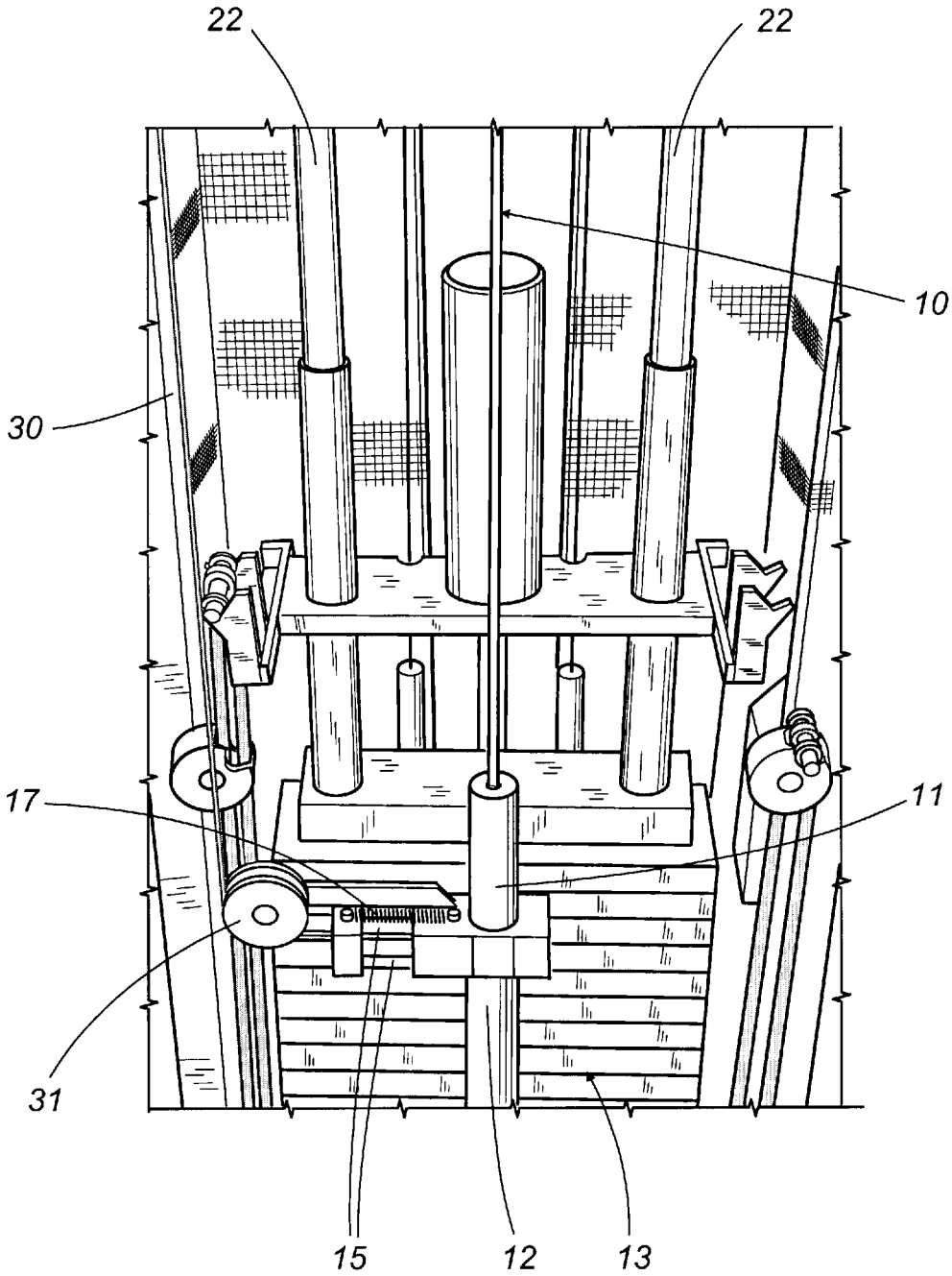

The fastening means described above therefore allow to anchor, in a first operative condition, the movable bar 11 to the fixed guide 12 so as to oppose to the traction force applied to the pivot pin 7 of the pulley 5 a reaction force equal to twice the weight of the stack 13. In the second operative condition, the fastening means instead allow the free translation of the bar 11 that partially projects from the guide 12 and rises back towards the overlying movable structure 6, until its rise is then locked by the reaching of a condition of mechanical abutment with the support structure 6, whereupon the further sliding of the branch 9 of the cable element 8 is inhibited and the bar 11 connected thereto stops projecting from the guide 12 (FIG. 4). Once the condition whereby the sliding of the branch 9 is blocked is reached, the traction force applied to the pivot pin 7 is opposed by a reaction force equal to the weight of the stack 13.

Figure 5:
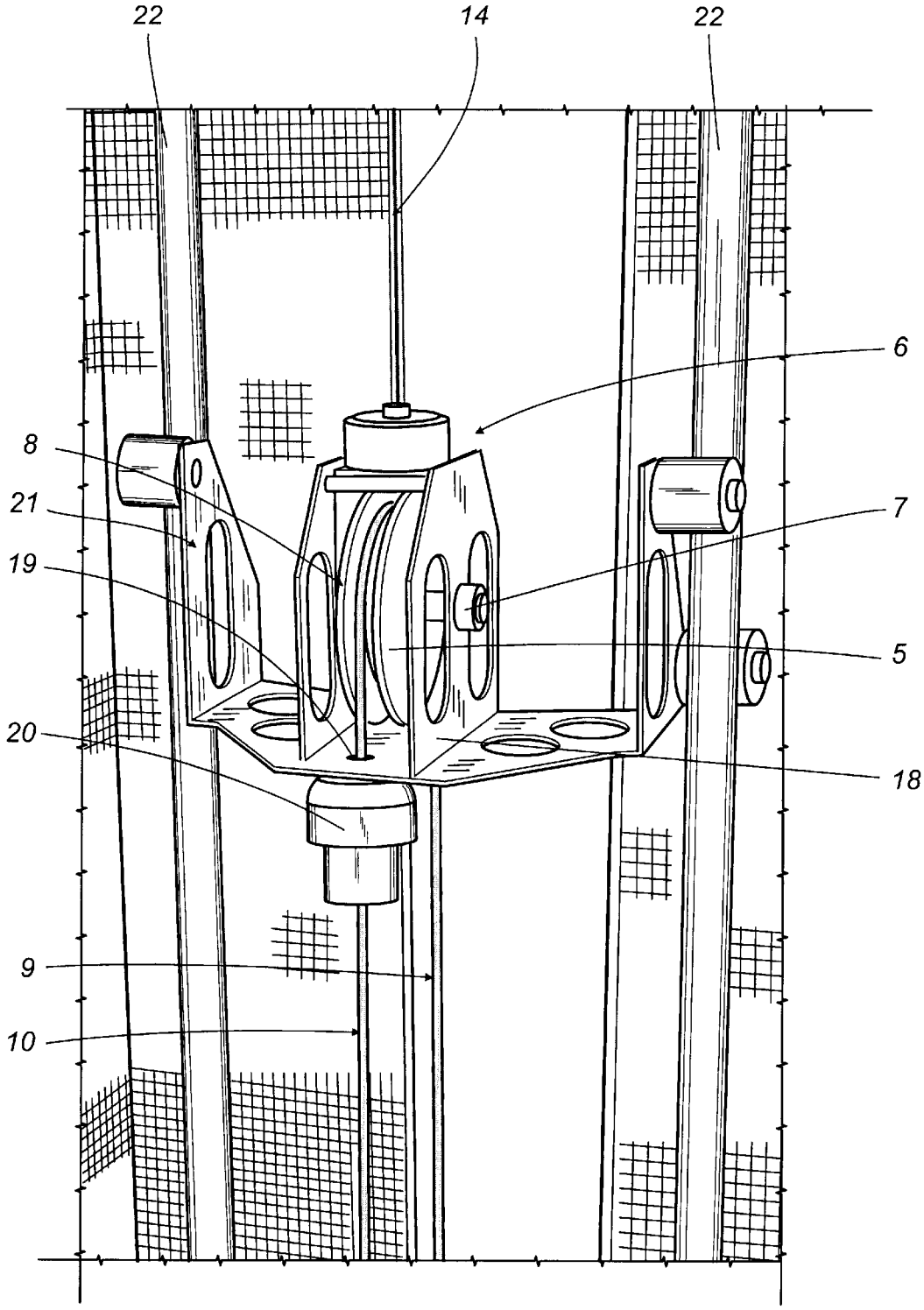
FIG. 5 shows, in enlarged scale, some significant details of the device.

The locking of the rise of the branch 9 of the cable element 8, without its departure from the pulley 5, is obtained through the combined action of a wall 18 of the movable structure 6 with an abutment element 20 integral with said first branch 9. As FIG. 5 shows, since the wall 18 is traversed by a hole 19 along which slides the first branch 9 of the cable element connected to the bar 11, and since the hole 19 has a smaller diameter than the dimensions of the abutment element 20, when the latter comes in contact with the wall 18, the sliding of the first branch 9 is stopped.

Figure 3:
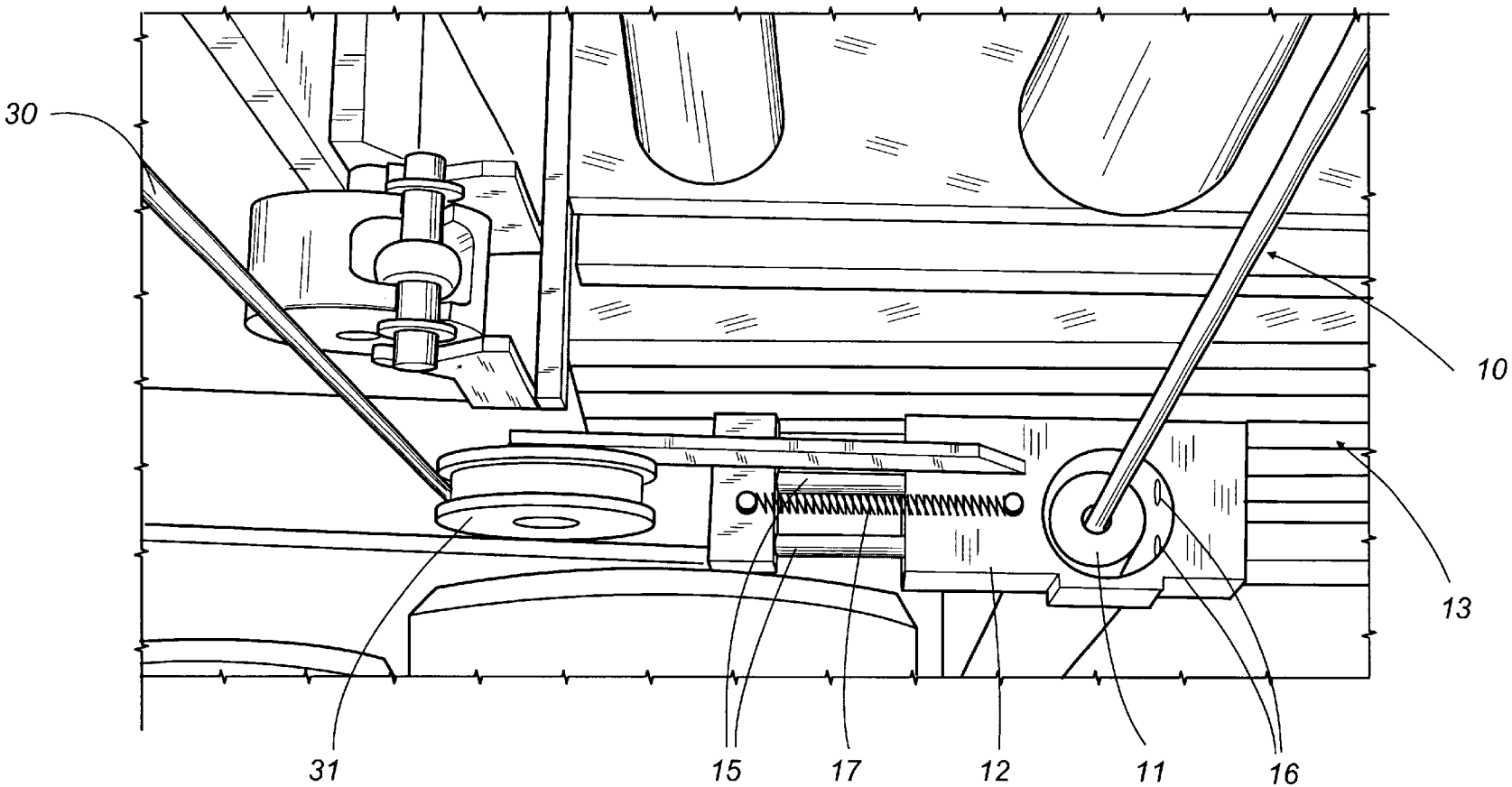

In regard to the operation of the pins 15, from FIGS. 3 and 4 it is immediately apparent that the extreme end stop positions can be reached in correspondence with the imbalance between a force for the extraction of the pins 15 from the seat 16, remotely applied, by means of a wire 30 routed by a related pulley 31 and connected to a knob, and an opposite reaction force applied by elastic reaction means 17 that recall the pins 15 inside the related seats 16.

The invention thus conceived is suitable for evident industrial application; furthermore, it can be subject to numerous modifications and variations without thereby departing from the scope of the inventive concept. Moreover, all components can be replaced with technically equivalent elements.

What is claimed:

1. A device for selectively varying, in a mechanical transmission of an exercise apparatus connecting a movement organ receiving a muscle action of a person performing the exercise and resistive means that oppose said muscle action, the forces and the movements exchanged between said movement organ and said resistive means, comprising at least a pulley; a movable structure bearing a pivot pin for the rotation of the pulley to which structure is applied a traction force correlated to the effort which the person performing the exercise applies to said movement organ, said traction force being coplanar with, and directed transversely to, the axis of the pivot pin for the rotation of the pulley;

a cable element wound around an arc of the pulley in such a way as to form a pair of parallel branches, a first branch whereof has an end connected to the resistive means, the second branch instead having an end connected to a bar movable within a vertical fixed guide;

said device further comprising means for selectively fastening the movable bar and the fixed guide;

said fastening means anchoring, in a first operative condition, the movable bar to the fixed guide, thereby opposing the traction force applied to the pivot pin of the pulley with a reaction force whose intensity is twice as large as that of the reaction force of the resistive means;

said fastening means instead allowing, in their second operative condition, the bar to translate freely relative to the guide and until it reaches an abutting condition against the movable support structure in which the traction force applied to the pivot pin is opposed by a reaction force equal to the reaction force of the resistive means.

2. A device as claimed in claim 1, wherein the resistive means include a stack of weights and the mechanical transmission includes a cable element for applying the muscle action of the person performing the exercise to the movable structure.

3. A device as claimed in claim 1, wherein said selective fastening means include at least a pin housed in a seat of the fixed guide, oriented transversely to the direction of sliding of the movable bar, said pin being translatable between extreme end stop positions, in a first end stop position whereof it intercepts the free sliding of the bar making the bar integral with the guide, in a second end stop position said pin instead allowing the bar to transit freely along the guide.

4. A device as claimed in claim 3, wherein said one or each pin is movable between said extreme end stop positions in correspondence with the imbalance between a force for their extraction from the seat, applicable selectively from the exterior of the device and an opposite force for their return into the seat, applied by elastic reaction means.

5. A device as claimed in claim 3, wherein said fastening means comprises two parallel pins, positioned bilaterally to the branch of cable element that connects the bar sliding within the fixed guide.

6. A device as claimed in claim 5, wherein said movable structure is provided with a wall traversed by a hole along which slides the first branch of the cable element connected to the bar, an abutment element integral with said first branch stopping the sliding of said first branch in correspondence with the reaching of said wall.

7. A device as claimed in claim 1, wherein said movable structure includes a carriage slidingly mounted on related sliding guides.

* * * * *